US007852011B2

(12) United States Patent
Peng

(10) Patent No.: US 7,852,011 B2
(45) Date of Patent: Dec. 14, 2010

(54) SERIES-TYPE LED LAMP STRIP MODULE

(75) Inventor: Wen-Chi Peng, Chung Ho (TW)

(73) Assignee: Semisilicon Technology Corp., Taipei (TW)

( * ) Notice: Subject to any disclaimer, the term of this patent is extended or adjusted under 35 U.S.C. 154(b) by 242 days.

(21) Appl. No.: 12/135,483

(22) Filed: Jun. 9, 2008

(65) Prior Publication Data

US 2009/0302771 A1 Dec. 10, 2009

(51) Int. Cl.
*H05B 37/00* (2006.01)

(52) U.S. Cl. ..... 315/185 R; 315/193; 315/185 S; 315/312

(58) Field of Classification Search ..... 315/185 R, 315/186, 193, 185 S, 200 R, 201, 205, 312; 362/227, 235, 251–252, 800, 806
See application file for complete search history.

(56) References Cited

U.S. PATENT DOCUMENTS 6,072,280 A * 6/2000 Allen ..... 315/185 S
7,250,730 B1 * 7/2007 Allen ..... 315/185 R
7,276,858 B2 * 10/2007 Allen ..... 315/205
7,377,802 B2 * 5/2008 Allen ..... 439/490
7,501,772 B2 * 3/2009 Chung et al. ..... 315/185 R
7,508,141 B2 * 3/2009 Wong ..... 315/185 S
7,609,006 B2 * 10/2009 Gibboney ..... 315/200 R
7,649,322 B2 * 1/2010 Neuman et al. ..... 315/185 S
2006/0193131 A1 * 8/2006 McGrath et al. ..... 362/227
2007/0217209 A1 * 9/2007 Wong ..... 362/418

* cited by examiner

*Primary Examiner*—Douglas W Owens
*Assistant Examiner*—Tung X Le
(74) *Attorney, Agent, or Firm*—Chun-Ming Shih; HDLS IPR Services

(57) ABSTRACT

A series-type LED lamp strip module includes a first LED lamp strip module and a second LED lamp strip module. The first LED lamp strip module and the second LED lamp strip module both include a power switch controller, at lease one LED lamp strip, a signal output adaptor, a signal input adaptor, a power plug, and a power socket. The power plug of the second LED lamp strip module is inserted into the power socket of the first LED lamp strip module, and the signal output adaptor of the first LED lamp strip module is electrically connected to the signal input adaptor of the second LED lamp strip module so as to connect the first LED lamp strip module and the second LED lamp strip module. In addition, a microcontroller unit outputs a control signal to lighten light emitting diodes in different types to produce multiple brightness variations.

10 Claims, 11 Drawing Sheets

SERIES-TYPE LED LAMP STRIP MODULE

BACKGROUND OF THE INVENTION

1. Field of the Invention

The present invention relates to a lamp strip module, and more particularly to a series-type LED lamp strip module.

2. Description of the Related Art

Light emitting diode (LED) is a solid-state electronic device and provides luminescence properties. The LEDs are widely used recently for decoration of trees, scenery designing, signboard, external walls of the building, and so on, because of small size, long life, low power, rapid response, and strong shake-proof property for the LEDs.

The disclosed LED lamp strip modules are divided into two groups. The first one is parallel-type LED lamp strip modules and the second one is serial-type LED lamp strip modules. Reference is made to FIG. 1 which is a schematic view of a prior art LED lamp strip module. A LED lamp 100 is parallel connected to a power converter 200 between an anode pin 101 and a cathode pin 102 of the LED lamp 100. A signal line 201 of the power converter 200 is electrically connected to a signal input end 103 of the LED lamp 100, and a signal output end 104 of the LED lamp 100 is electrically connected to a signal input end 103 of the next LED lamp 100. The power converter 200 outputs a control signal from the signal line 201 to lighten the LED lamp 100 in different types to produce multiple brightness variations. However, the parallel-type LED lamp 100 produces larger power consumption and the amount of the LED lamp 100 driven is limited.

Reference is made to FIG. 2 which is a schematic view of another prior art LED lamp strip module. The LED lamp 100 is serially connected to the power converter 200. The signal line 201 of the power converter 200 is electrically connected to the signal input end 103 of the LED lamp 100, and the signal output end 104 is electrically connected to a signal input end 103 of the next LED lamp 100. The power converter 200 outputs a control signal from the signal line 201 to lighten the LED lamp 100 in different types to produce multiple brightness variations.

Because the LED lamp 100 is serially connected to the power converter 200, the serial-type LED lamp 100 produces lower power consumption, and the power converter 200 is easily manufactured in lower costs. However, the amount of the driven LED lamp 100 is relevant with the supplied D.C. voltage of the power converter 200. The number of serially-connected LED lamps 100 is limited unless a high power converter 200 is used.

Moreover, the serially-connected LED lamp 100 shown in FIG. 2 is hard to use in compatible way with the parallel-type LED lamps 100 shown in FIG. 1. It is desirable to propose LED lamp strip which can be easily connected to another LED lamp strip in serial manner.

SUMMARY OF THE INVENTION

Accordingly, a primary object of the present invention is to provide a series-type LED lamp strip module to reduce energy consumption and overcome connection limitation of the prior art LED lamp.

In order to achieve the objectives mentioned above, a series-type LED lamp strip module comprises a first LED lamp strip module and a second LED lamp strip module. The first LED lamp strip module and the second LED lamp strip module both at least include a power switch controller, at lease one LED lamp strip, a signal output adaptor, a signal input adaptor, a power plug, and a power socket. The power plug of the first LED lamp strip module is connected to the utility power and the power plug of the second LED lamp strip module is connected to the power socket of the first LED lamp strip module when the first LED lamp strip module is electrically connected to the second LED lamp strip module. The signal output adaptor is electrically connected to the signal input adaptor. A microcontroller unit outputs a control signal to lighten light emitting diodes in different types to produce multiple brightness variations.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF DRAWING

The above and further advantages of this invention may be better understood by referring to the following description, taken in conjunction with the accompanying drawings, in which:

FIG. 5(*b*) is a block diagram of an inner circuit of the LED lamp;

Figure 1:
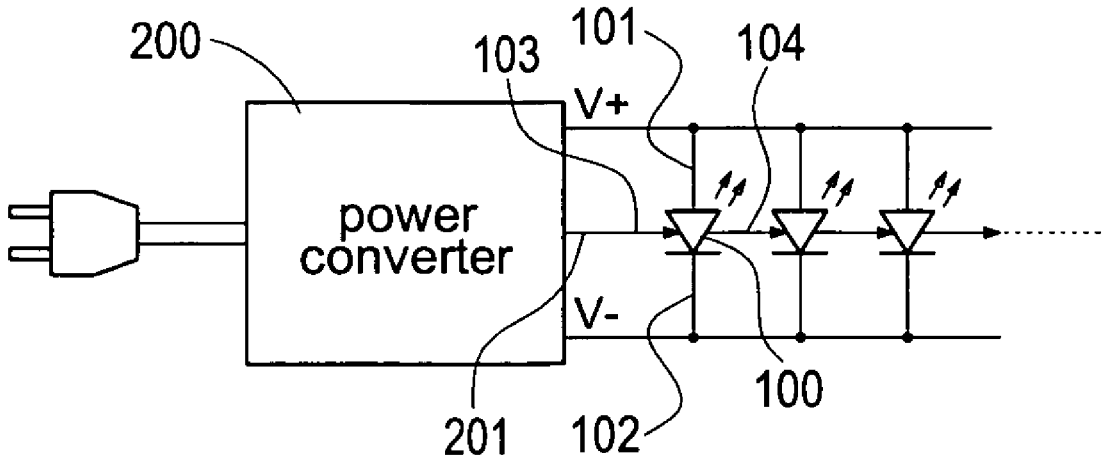
FIG.1 PRIOR ART
FIG. 1 is a schematic view of a prior art LED lamp strip module.
Figure 2:
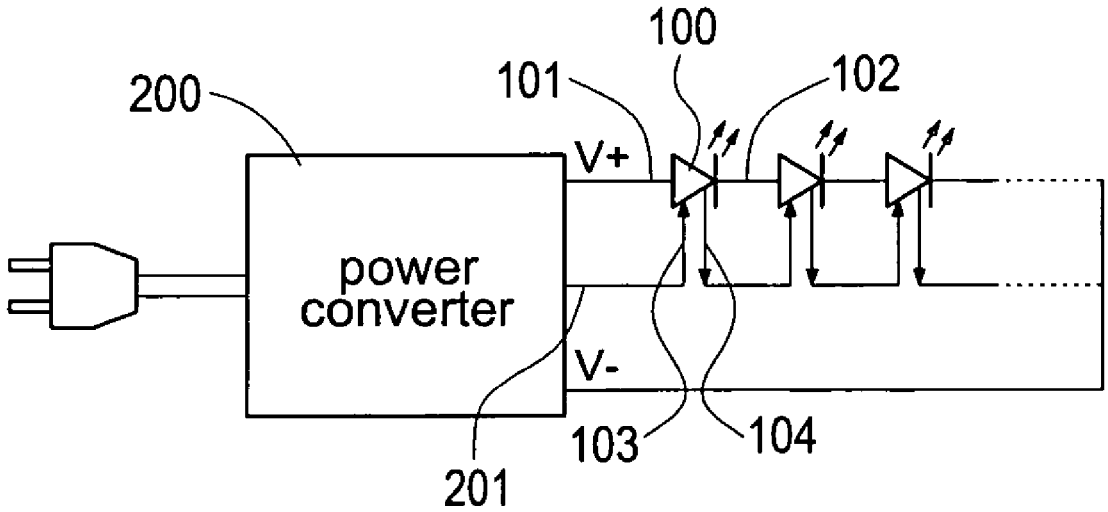
FIG.2 PRIOR ART
FIG. 2 is a schematic view of another prior art LED lamp strip module.

The drawings will be described further in connection with the following detailed description of the present invention.

DETAILED DESCRIPTION OF THE INVENTION

Reference will now be made to the drawing figures to describe the present invention in detail.

Figure 3:
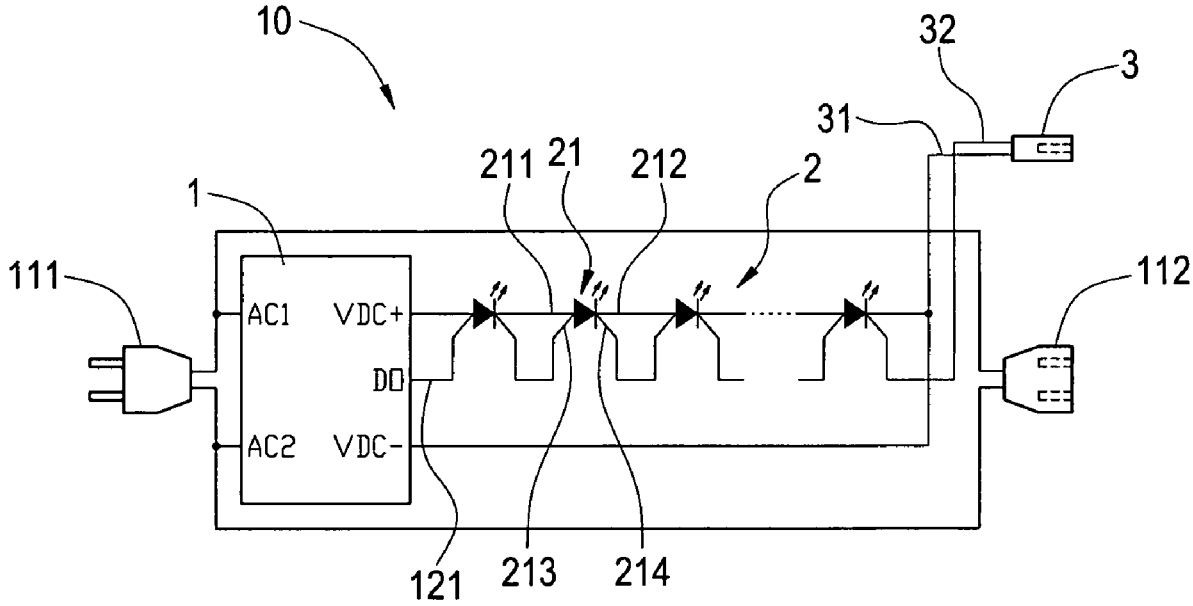
FIG. 3 is a schematic view of a first LED lamp strip module according to the present invention.
Figure 4A:
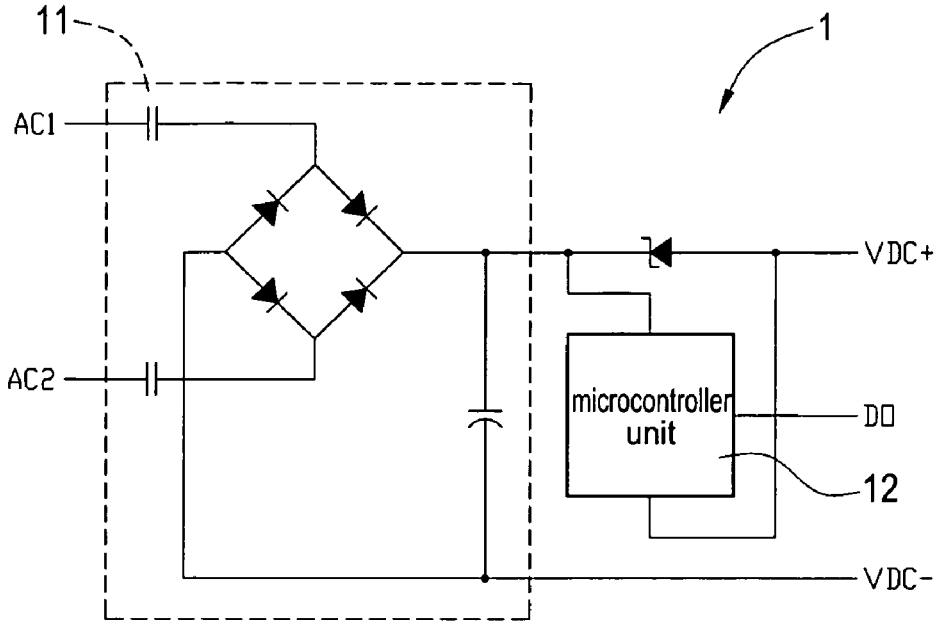
FIG. 4(*a*)-FIG. 4(*d*) are schematic views of four power switch controllers.
Figure 4B:
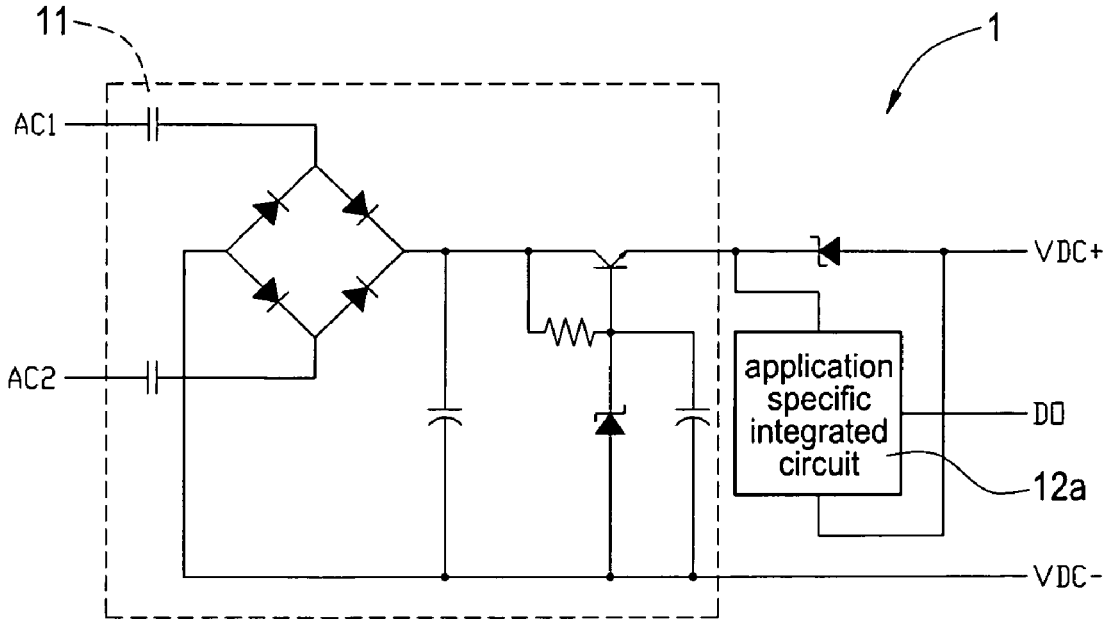
Figure 4C:
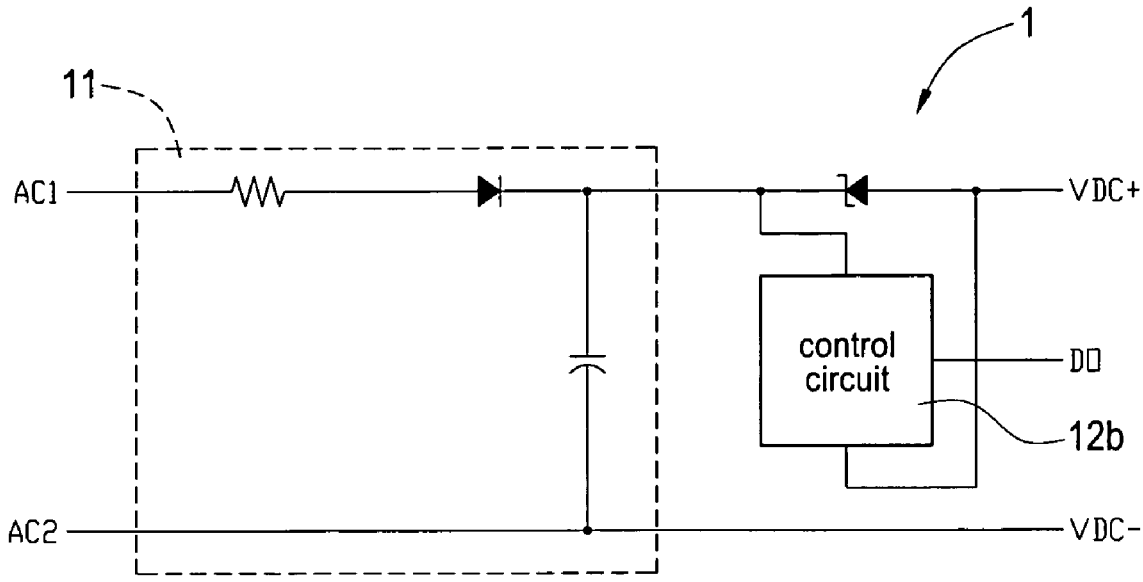
Figure 4D:
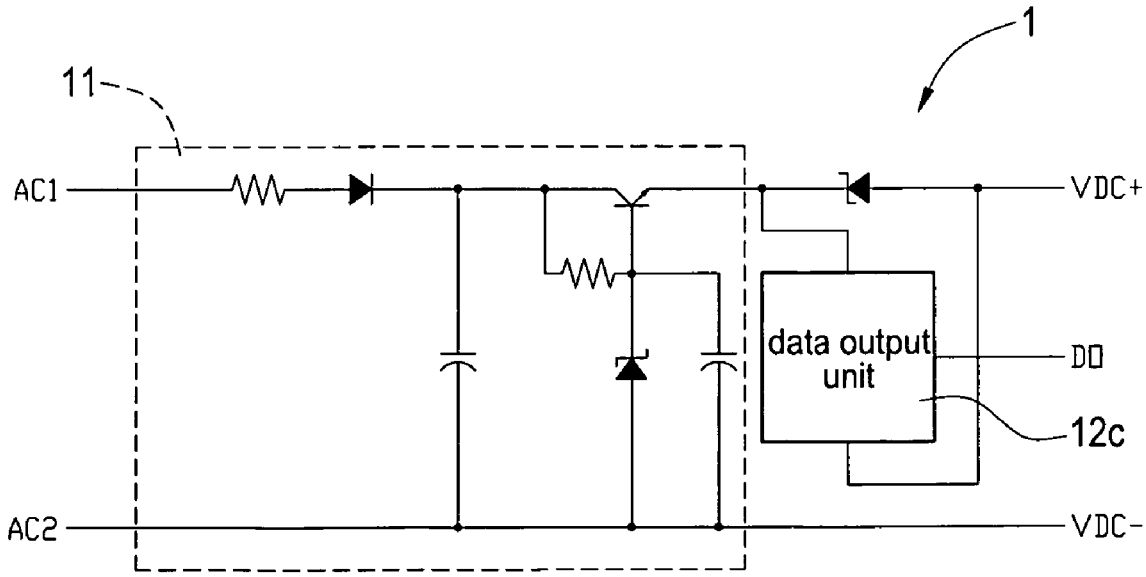

Reference is made to FIG. 3 which is a schematic view of a first LED lamp strip module according to the present invention. A series-type LED lamp strip module comprises a first LED lamp strip module 10. The first LED lamp strip module 10 includes a power switch controller 1, at least one LED lamp strip 2, and a signal output adaptor 3.

The power switch controller 1 at least has a power switch unit 11 and a microcontroller unit 12. The power switch unit 11 has an input end, and the input end is electrically connected to a power plug 111 and a power socket 112. An A.C. power source is inputted via the power plug 111 and the A.C.

power source is converted into a D.C. power source by the power switch unit 11. The power socket 112 is inserted by a source plug of the second LED lamp strip module 20. The microcontroller unit 12 provides a signal output control end 121 to electrically connect to the LED lamp strip 2. The microcontroller unit 12 installs a control program therein to control whether the light emitting diodes of the LED lamp strip 2 illuminate or not. The power switch unit 11 at least comprises a rectifying circuit, a filtering circuit, and a stabilizing circuit, and the power switch unit 11 is electrically connected to the microcontroller unit 12. The power switch unit 11 also comprises at least one rectifying circuit and one filtering circuit, and the power switch unit 11 is electrically connected to the microcontroller unit 12, as shown in FIG. 4(*a*) to FIG. 4(*d*), there are schematic views showing different ways of electrically connecting the power switch unit 11 to the microcontroller unit 12. The power switch unit 11 is also electrically connected to an application specific integrated circuit 12*a*, a control circuit 12*b*, or a data output unit 12*c*, respectively, as shown in FIG. 4(*b*) to FIG. 4(*d*).

Figure 5A:
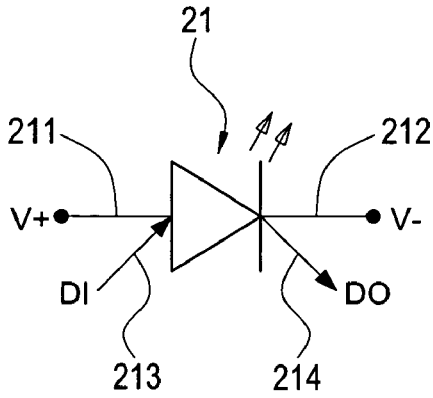
FIG. 5(*a*) is a symbol schematic view of a LED lamp.
Figure 5B:
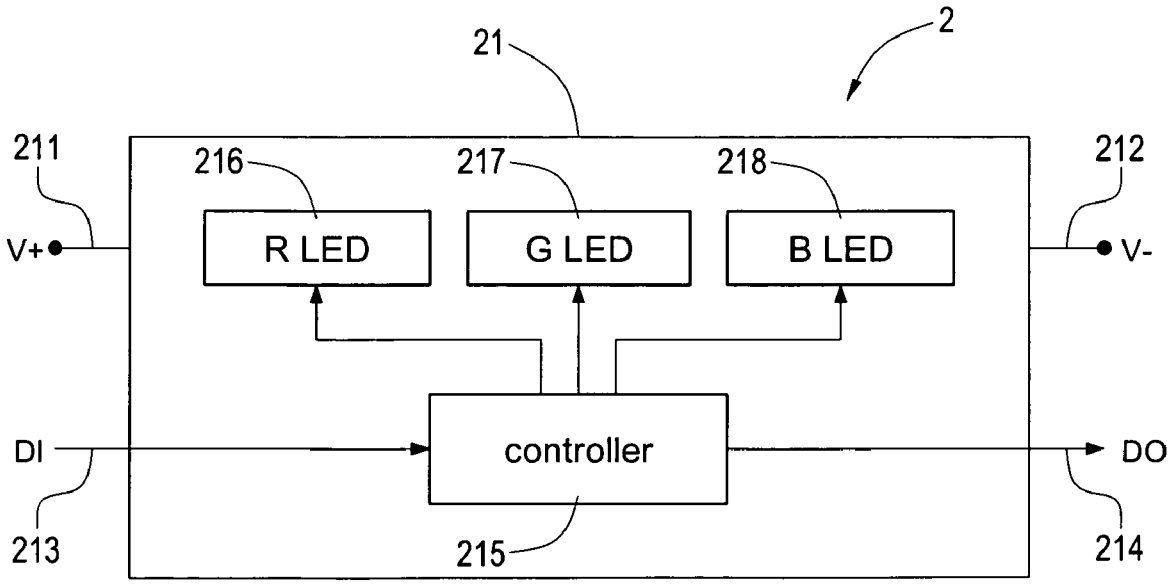

Reference is made to FIG. 5(*a*) which is a symbol schematic view of a LED lamp. The LED lamp strip 2 is composed of serially connecting a plurality of multi-color or full-color light emitting diodes 21, and each of the light emitting diodes 21 has an anode pin (V+) 211, a cathode pin (V−) 212, a signal input pin (DI) 213, and a signal output pin (DO) 214. Reference is made to FIG. 5(*b*) which is a block diagram of an inner circuit of the LED lamp. The light emitting diode 21 further has a controller 215 therein, and the controller 215 is electrically connected to a red LED chip 216, a green LED chip 217, and a blue LED chip 218, respectively. A positive voltage output end (VDC+) of the power switch unit 11 is electrically connected to the anode pin 211 of the first light emitting diode 21 of the LED lamp strip 2. The cathode pin 212 of the first light emitting diode 21 is electrically connected to the anode pin 211 of the second light emitting diode 21. Finally, the cathode pin 212 of the last light emitting diode 21 is electrically connected to a negative voltage output end (VDC−) of the power switch unit 11. In addition, the signal input pin 213 of the first light emitting diode 21 is electrically connected to the signal output control end 121 of the microcontroller unit 12, and the signal output pin 214 of the first light emitting diode 21 is electrically connected to the signal input pin 213 of the second light emitting diode 21 until the last light emitting diode 21 is electrically connected.

The signal output adaptor 3 has a first input end 31 and a second input end 32. The first input end 31 is electrically connected to the cathode pin 212 of the last light emitting diode 21 and the negative voltage output end (VDC−) of the power switch unit 11. The second input end 32 is electrically connected to the signal output pin (DO) 214 of the last light emitting diode 21. A control signal outputted from the first LED lamp strip module 10 is transmitted to the second LED lamp strip module 20 when the signal output adaptor 3 is electrically connected to a second lamp strip module (not shown).

Figure 6:
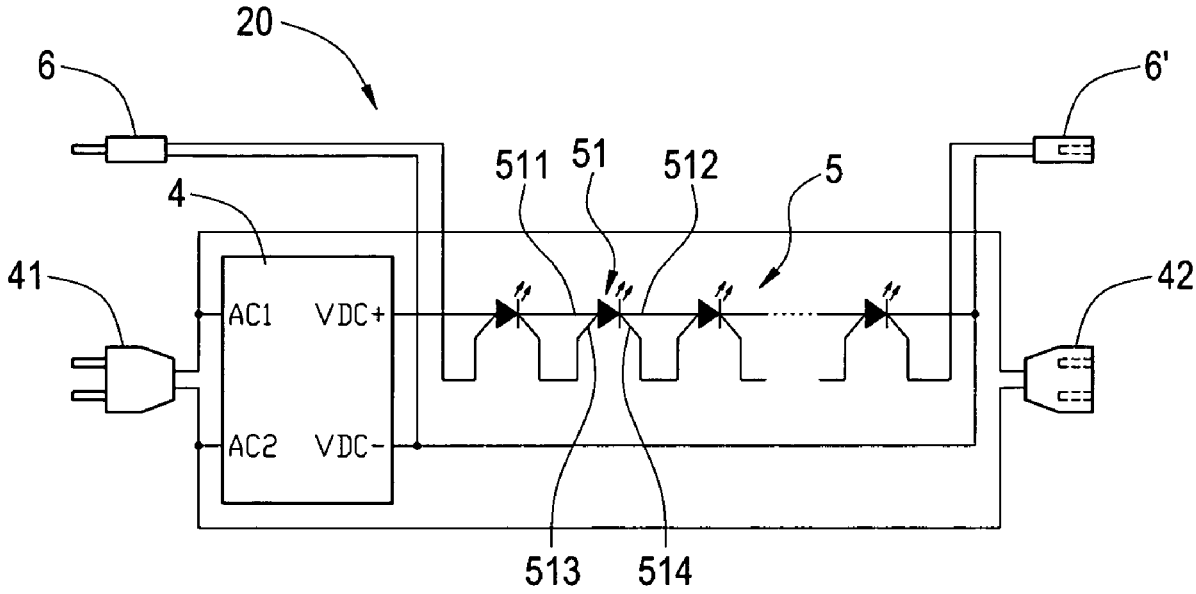
FIG. 6 is a schematic view of a second LED lamp strip module.

Reference is made to FIG. 6 which is a schematic view of a second LED lamp strip module. The second LED lamp strip module 20 is almost the same as the first LED lamp strip module 10. The first LED lamp strip module 10 is different from the second LED lamp strip module 20 is that an anode pin (V+) 511 of a first light emitting diode 51 of a LED lamp strip 5 and a cathode pin (V−) 512 of the last light emitting diode 51 are electrically connected to a power switch unit 4. A signal input pin 513 of the first light emitting diode 51 is not electrically connected to the power switch unit 4. The signal input pin 513 is electrically connected to a signal input adaptor 6, and the signal input adaptor 6 is electrically connected to the signal output adaptor 3 of the first LED lamp strip module 10. A signal output pin 514 of the last light emitting diode 51 is electrically connected to a signal output adaptor 6', and the signal output adaptor 6' is electrically connected to a signal input adaptor 6 of the next second LED lamp strip module 20.

Figure 7:
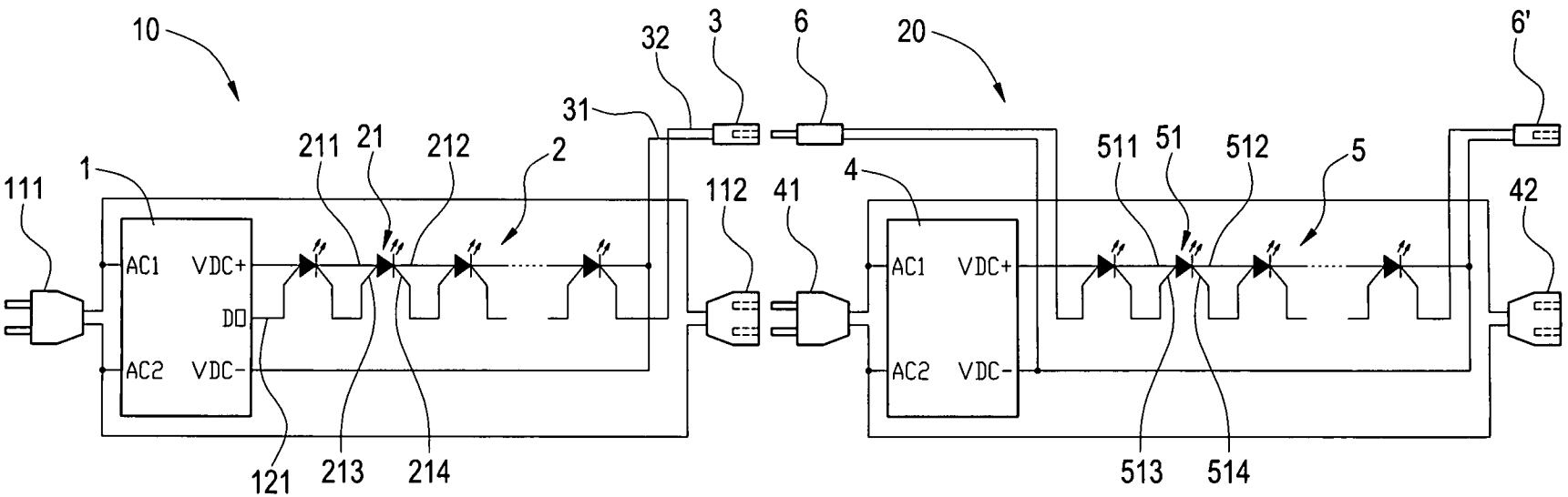
FIG. 7 is a schematic view of connecting the first LED lamp strip module and the second LED lamp strip module.

Reference is made to FIG. 7 which is a schematic view of connecting the first LED lamp strip module and the second LED lamp strip module. The second LED lamp strip module 20 can serially connected to other second LED lamp strip modules 20 when the first LED lamp strip module 10 is serially connected to the second LED lamp strip module 20. The power plug 111 of the first LED lamp strip module 10 is connected to the utility power when the first LED lamp strip module 10 is electrically connected to the second LED lamp strip module 20. A power plug 41 of the second LED lamp strip module 20 is inserted into the power socket 112 of the first LED lamp strip module 10. A power socket 42 is inserted by the power plug 41 of the next second LED lamp strip module 20 to electrically connect between the first LED lamp strip module 10 and the second LED lamp strip module 20. The signal output adaptor 3 is electrically connected to a signal input adaptor 6.

The microcontroller unit 12 outputs a control signal from the signal output control end (DO) 121. The control signal is received by the controller 215 (shown in FIG. 5(*b*)) of the light emitting diode 21 or the light emitting diode 51 to lighten the red LED chip 216, the green LED chip 217, and the blue LED chip 218 to produce multiple brightness variations for the LED lamp strips 2 of the first LED lamp strip module 10 and the LED lamp strips 5 of the first LED lamp strip module 20.

Figure 8:
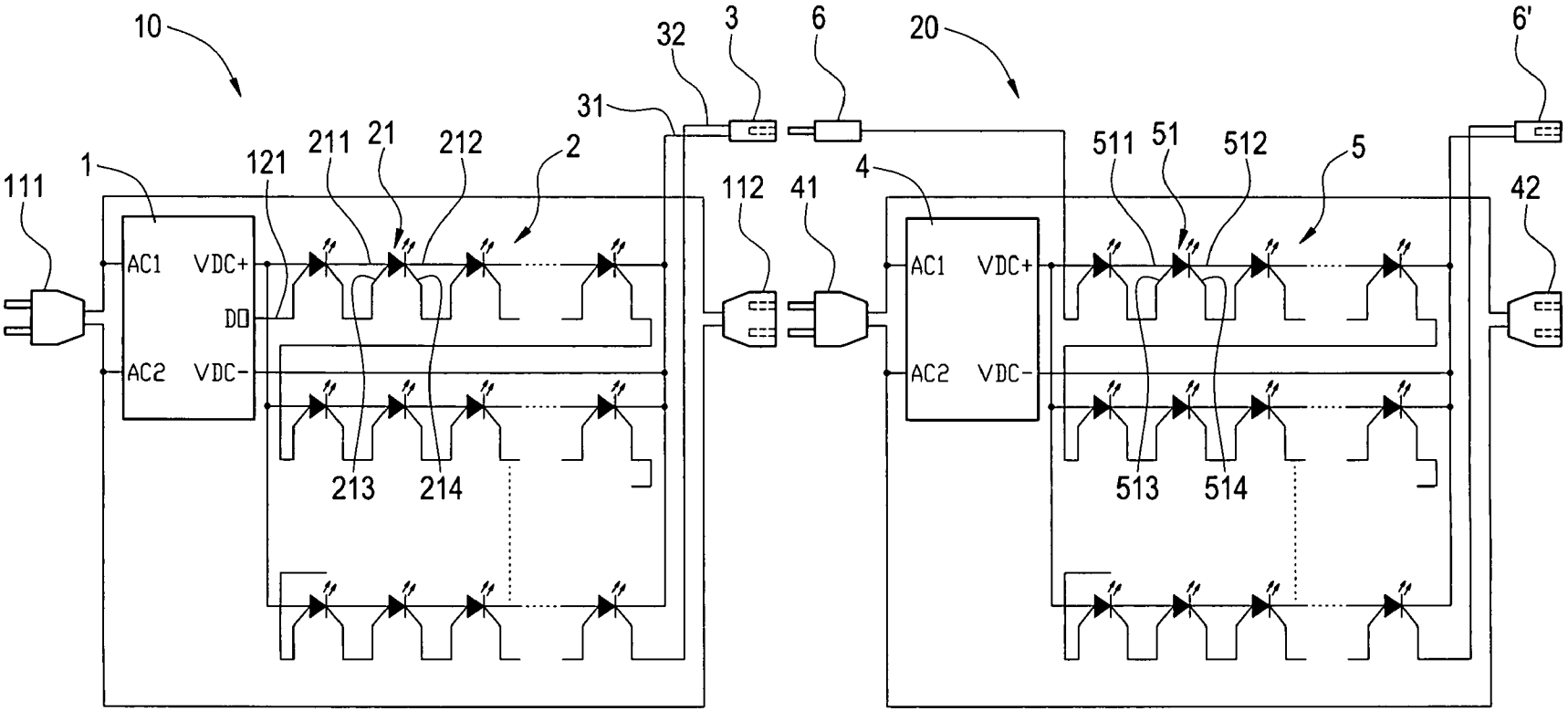
FIG. 8 is a schematic view of another embodiment of connecting the first LED lamp strip module and the second LED lamp strip module.

Reference is made to FIG. 8 which is a schematic view of another embodiment of connecting the first LED lamp strip module and the second LED lamp strip module. The embodiment shown in the FIG. 8 is almost the same as the embodiment shown in the FIG. 7. The difference is that the first LED lamp strip module 10 and the second LED lamp strip module 20 are serially connected to multiple LED lamp strips 2 and LED lamp strips 5, respectively. The LED lamp strips 2 and the LED lamp strips 5 are controlled by the power switch controller 1 to produce multiple brightness variations.

Figure 9:
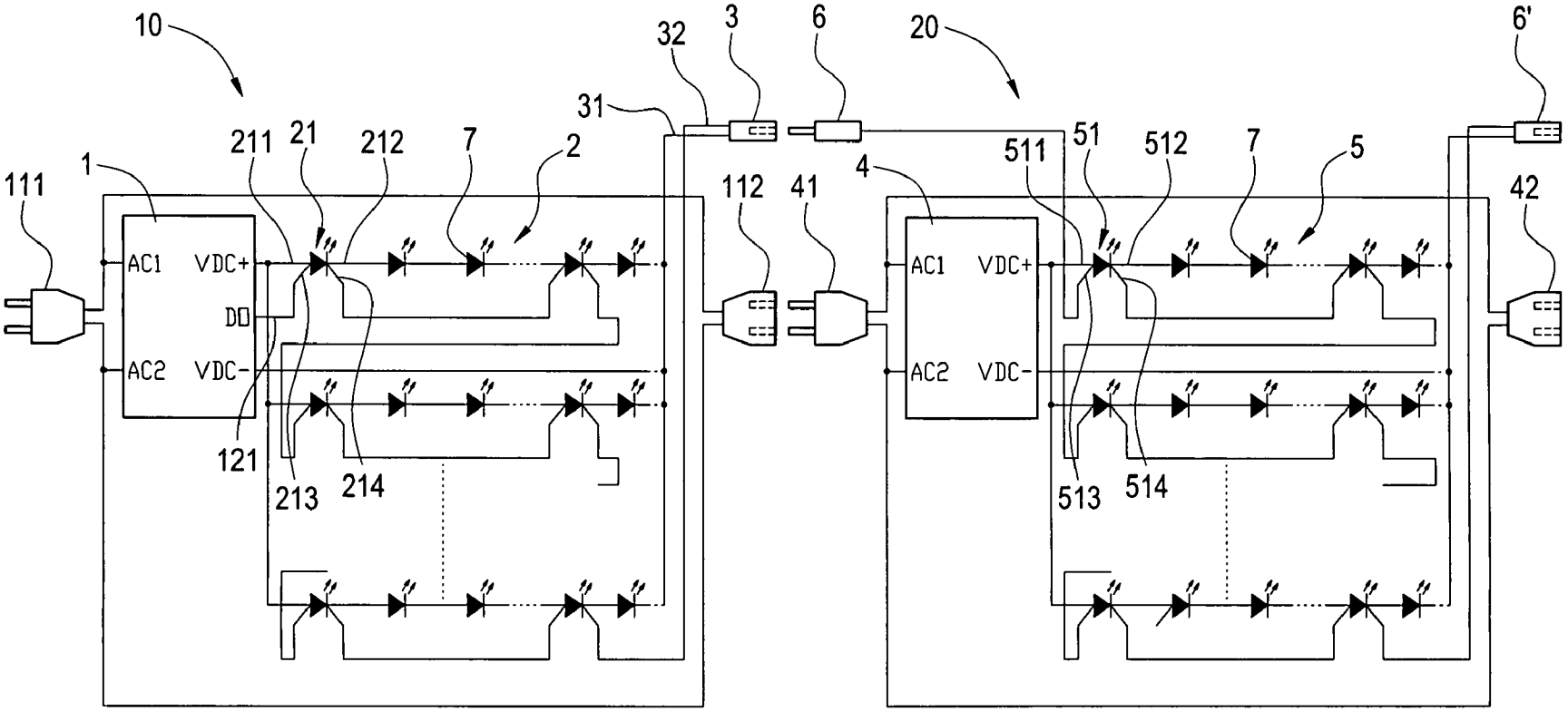
FIG. 9 is a schematic view of further embodiment of connecting the first LED lamp strip module and the second LED lamp strip module.

Reference is made to FIG. 9 which is a schematic view of further embodiment of connecting the first LED lamp strip module and the second LED lamp strip module. The embodiment shown in the FIG. 9 is almost the same as the embodiment shown in the FIG. 8. The difference is that the first LED lamp strip module 10 and the second LED lamp strip module 20 are serially connected to multiple LED lamp strips 2 and LED lamp strips 5, respectively. In addition, each LED lamp strip 2 is composed of serially connecting not only the four-pin light emitting diodes 21 but also general two-pin light emitting diodes 7, and each LED lamp strip 5 is composed of serially connecting not only the four-pin light emitting diodes 51 but also the general two-pin light emitting diodes 7. The four-pin light emitting diodes 21, the four-pin light emitting diodes 51, and the two-pin light emitting diodes 7 are controlled by the power switch controller 1 to produce multiple brightness variations.

Figure 10:
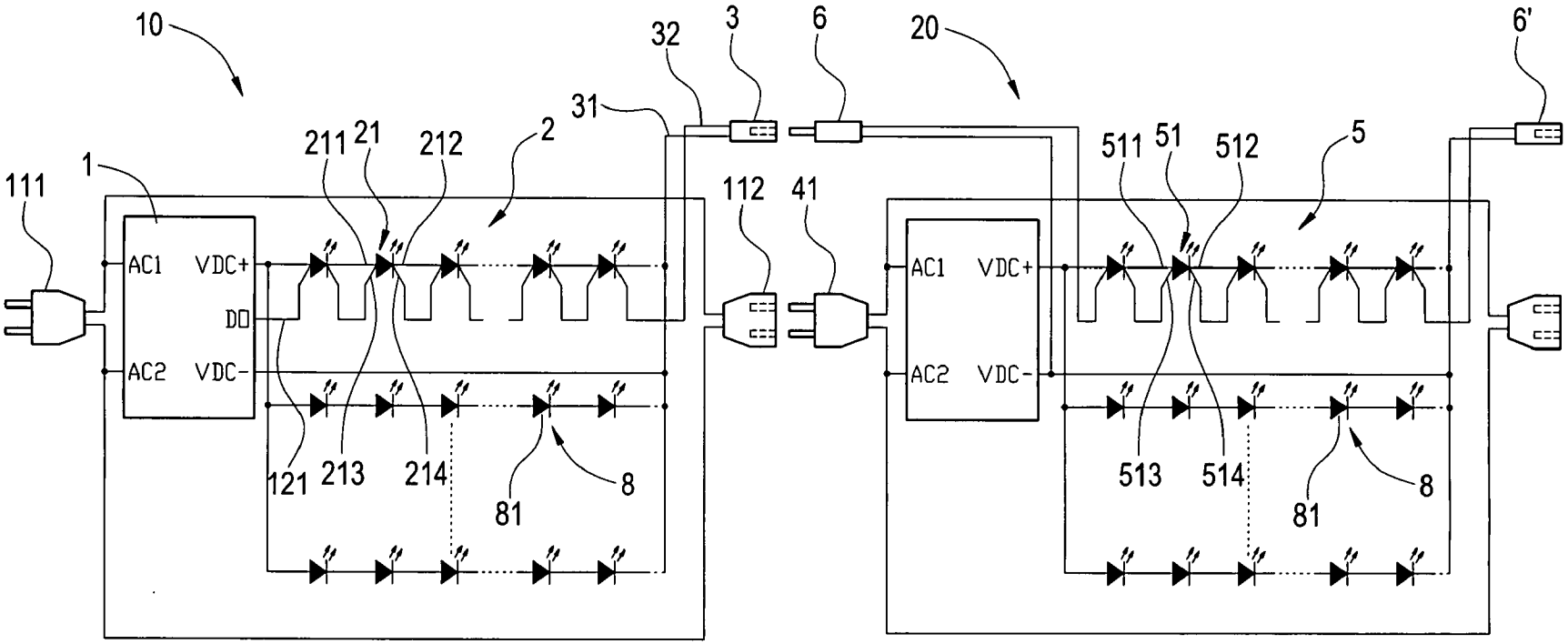
FIG. 10 is a schematic view of further embodiment of connecting the first LED lamp strip module and the second LED lamp strip module.

Reference is made to FIG. 10 which is a schematic view of further embodiment of connecting the first LED lamp strip module and the second LED lamp strip module. The embodiment shown in the FIG. 10 is almost the same as the embodiment shown in the FIG. 9. The difference is that the first LED lamp strip module 10 and the second LED lamp strip module 20 are serially connected to at least one LED lamp strip 2 and one LED lamp strip 5, respectively. In addition, each LED lamp strip 2 and each LED lamp strip 5 are serially connected to a LED lamp strip 8, respectively. The LED lamp strip 8 is composed of serially connecting a plurality of general two-pin light emitting diodes 81. The four-pin light emitting diodes 21, the four-pin light emitting diodes 51, and the two-pin light emitting diodes 81 are controlled by the power switch controller 1 to produce multiple brightness variations.

Figure 11:
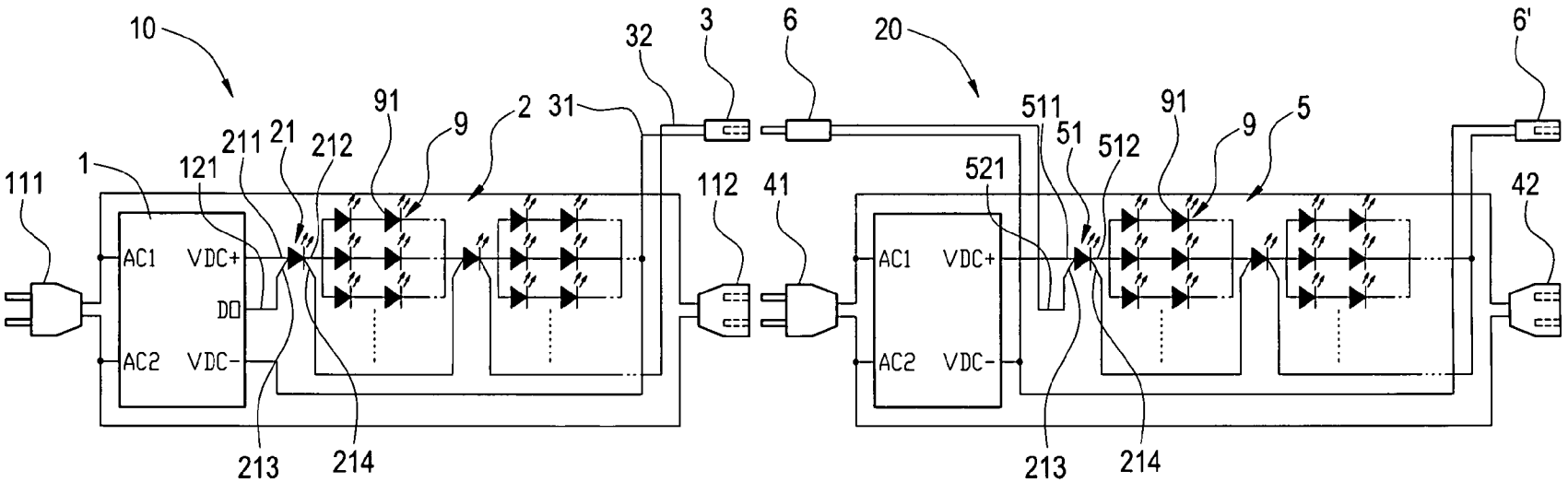
FIG. 11 is a schematic view of further embodiment of connecting the first LED lamp strip module and the second LED lamp strip module.

Reference is made to FIG. 11 which is a schematic view of further embodiment of connecting the first LED lamp strip module and the second LED lamp strip module. The embodiment shown in the FIG. 11 is almost the same as the embodiment shown in the FIG. 10. The difference is that the first LED lamp strip module 10 and the second LED lamp strip module 20 are serially connected to at least one LED lamp strip 2 and one LED lamp strip 5, respectively. The four-pin light emitting diodes 21 and the four-pin light emitting diodes 51 are serially connected to parallel-serial LED lamp strips 9, respectively. The LED lamp strip 9 is composed of serially connecting a plurality of general two-pin light emitting diodes 91. The four-pin light emitting diodes 21, the four-pin light emitting diodes 51, and the two-pin light emitting diodes 91 are controlled by the power switch controller 1 to produce multiple brightness variations.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A series-type LED lamp strip module having a first LED lamp strip module, and the first LED lamp strip module comprising:

a power switch controller comprising a first power switch unit and a microcontroller unit electrically connected to the first power switch unit, the first power switch unit providing a positive power output end and a negative power output end, and the microcontroller unit providing a control signal output end;

at least one first light emitting diode (LED) lamp strip, comprising a plurality of serially-connected LEDs, each LED having a LED chip and a controller electrically connected to the LED chip and providing an anode pin, a cathode pin, a signal input pin and a signal output pin, a first LED of the serially-connected LED having the anode pin electrically connected to the positive power output end, the cathode pin of the first LED being electronically connected to the anode pin of a second LED, and the cathode pin of a third LED being electronically connected to the negative power output end, and the control signal output end of the microcontroller unit being electronically connected the signal input pin of the first LED and through the controller of the first LED the signal output pin of the first LED being electronically connected to the signal input pin of the second LED, so that the microcontroller unit installed a control program therein controls which LED illuminates; and a first signal output adaptor having a first input end electrically connected to the cathode pin of the last LED and the negative power output end, and a second input end electrically connected to the signal output pin of the last LED to provide an output control signal, wherein the first LED lamp strip module is serially connected to a second LED lamp strip module, and the second LED lamp strip module comprising:

a second power switch unit comprising a positive power connection end and a negative power connection end;

at least one second LED lamp strip electrically connected to the second power switch unit;

a signal input adaptor electrically connected to the second power switch unit and a signal input end of the second LED lamp strip to receive the output control signal of the first LED lamp strip module to control the second LED lamp strip module; and a second signal output adaptor electrically connected to the second power switch unit and a signal output end of the second LED lamp strip to provide another output control signal.

2. The series-type LED lamp strip module in claim 1, wherein the first power switch unit comprises a rectifying circuit, a filtering circuit, and a stabilizing circuit.

3. The series-type LED lamp strip module in claim 1, wherein the first power switch unit comprises a rectifying circuit and a filtering circuit.

4. The series-type LED lamp strip module in claim 1, wherein the microcontroller unit is an application specific integrated circuit.

5. The series-type LED lamp strip module in claim 1, wherein the microcontroller unit is a control circuit.

6. The series-type LED lamp strip module in claim 1, wherein the microcontroller unit is a data output unit.

7. The series-type LED lamp strip module in claim 1, wherein the power switch controller comprises an input end, and the input end is electrically connected to a power plug and a power socket.

8. The series-type LED lamp strip module in claim 1, wherein the light emitting diode chip is one of multi-color and full-color light emitting diode chip.

9. The series-type LED lamp strip module in claim 1, wherein the second power switch unit comprises a rectifying circuit, a filtering circuit, and a stabilizing circuit.

10. The series-type LED lamp strip module in claim 1, wherein the second power switch unit comprises a rectifying circuit and a filtering circuit.

* * * * *